United States Patent [19]

Frank

[11] Patent Number: 4,637,578

[45] Date of Patent: Jan. 20, 1987

[54] RAILROAD FROG HAVING MOVABLE WING RAILS

[75] Inventor: Earl E. Frank, Tallman, N.Y.

[73] Assignee: Abex Corporation, New York, N.Y.

[21] Appl. No.: 545,488

[22] Filed: Oct. 26, 1983

[51] Int. Cl.[4] ..... E01B 7/14

[52] U.S. Cl. ..... 246/391; 246/449; 246/392

[58] Field of Search ..... 246/415 R, 387, 435 R, 246/435 A, 432, 391, 392, 390, 382, 430, 449, 450; 238/1

[56] References Cited

U.S. PATENT DOCUMENTS

| | | | |
|---|---|---|---|
| 494,768 | 4/1893 | Wood | 246/391 |
| 719,461 | 2/1903 | Green et al. | 246/391 |
| 816,257 | 3/1906 | Shaw | 246/391 |
| 832,840 | 10/1906 | Carroll et al. | 246/391 |
| 1,247,447 | 11/1917 | Petty | 246/392 |
| 2,174,367 | 9/1939 | Hoffman | 246/468 |
| 3,910,534 | 10/1975 | Perrot | 246/382 X |

FOREIGN PATENT DOCUMENTS

| | | | |
|---|---|---|---|
| 308362 | 12/1917 | Fed. Rep. of Germany | 238/1 |
| 456667 | 7/1968 | Switzerland | 246/415 |
| 9447 | of 1909 | United Kingdom | 246/391 |

OTHER PUBLICATIONS

Modern Railroads–Feb. 1969, More Cant–Less Shelling, 230–1.

*Primary Examiner*—David A. Scherbel
*Assistant Examiner*—Glenn B. Foster
*Attorney, Agent, or Firm*—Kinzer, Plyer, Dorn & McEachran

[57] ABSTRACT

A railroad frog has either a cast or rail-built point, resting on a baseplate which is fastened to ties. A pair of heel rails are attached to the point, to the ties and to traffic rails. A pair of movable wing rails extend from the toe of the frog to a location adjacent the point of the frog. At the frog point an open wing rail forms a flangeway with the point, while the other, closed wing rail cooperates with the point to form a continuous tread surface through the frog. The wing rails are alternately thrown between the open and closed positions by an actuator. A series of stops define the open wing rail position and act to hold down the open wing rail. The wing rails have hinges which allow them to move. The wing rails have a full rail base at the hinges. Adaptor plates allow use of the frog on concrete ties.

7 Claims, 42 Drawing Figures

194
196
188
190
192
14
68
70
18
202
64
126
20
204

Fig. 31.
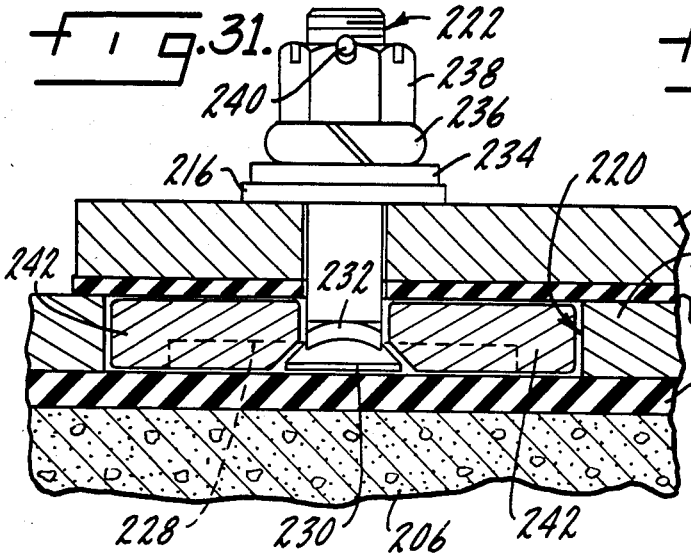
Fig. 32.
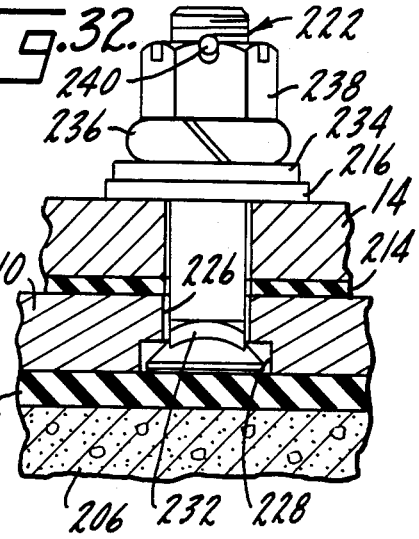
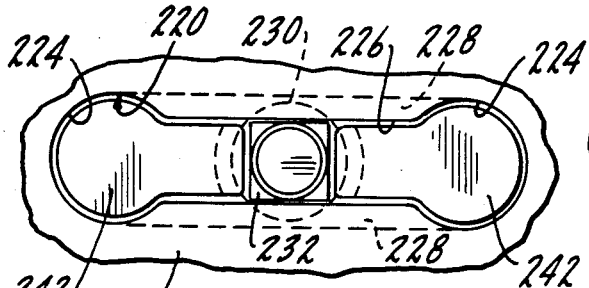
Fig. 33.
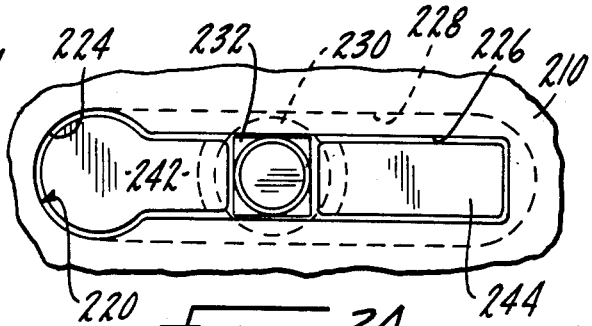
Fig. 34.
Fig. 35.
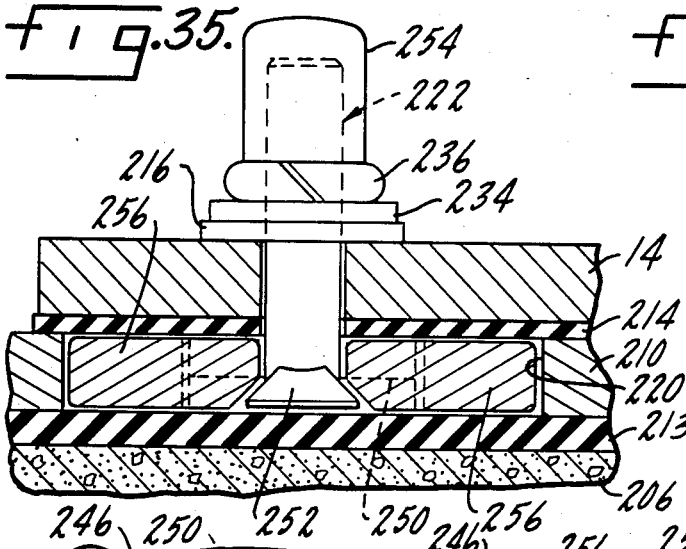
Fig. 36.
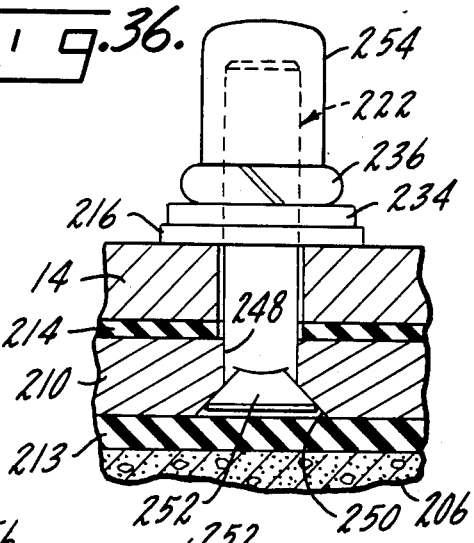
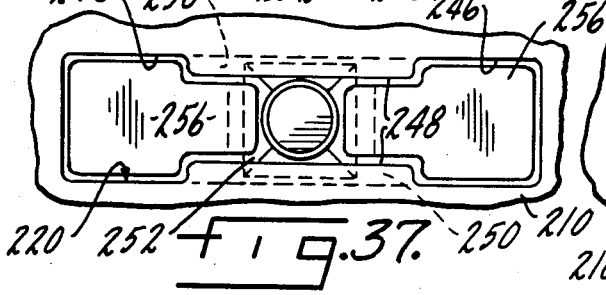
Fig. 37.
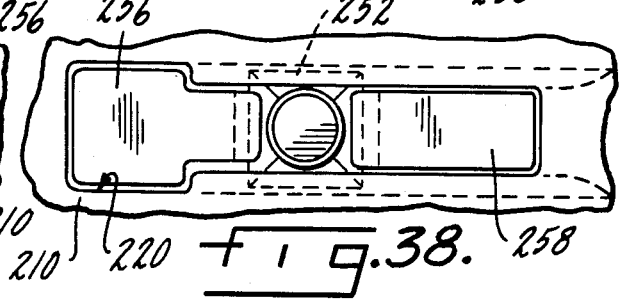
Fig. 38.

RAILROAD FROG HAVING MOVABLE WING RAILS

BACKGROUND OF THE INVENTION

This invention relates to railway track work and is particularly concerned with a frog for use on high speed railroad track.

High speed railroad traffic (trains traveling at over 100 mph) requires the use of movable frogs which have a continuous tread to support the wheels of passing traffic. Conventional spring rail frogs serve this purpose but in one direction only. That is, they will usually have a continuous tread in the straight through direction but not in the turn out direction. Thus, high speed traffic can travel only in the straight through direction; turn out traffic must pass the frog at a low speed. The present invention is concerned with frogs which allow passage of high speed traffic in either a straight through direction or a turn out direction.

Various arrangements have been tried in attempting to make a frog which handles high speed traffic in two directions. One way is to have fixed wing rails with a movable point between them. One problem with movable point frogs is that plastic deformation in the rail head of the point in the pivot area will eventually prevent it from seating tightly against the wing rails. In order for the moving point frog to work properly, a great deal of maintenance is required. For example, on some railroads it is necessary to inspect and maintain the frogs nightly to insure proper operation.

Another movable frog arrangement has fixed wing rails and movable point rails. To achieve a throw, one of the point rails is straight and mates with a wing rail but the other one must be bent out of the way to form a flangeway. In order to accomplish this the base of the point rails must be removed. This induces stress risers and weakens the rail.

SUMMARY OF THE INVENTION

This invention seeks to avoid the problems associated with prior movable point frogs by utilizing a fixed point and movable wing rails connected to a hinge.

A primary object of the present invention is a railroad frog which can accommodate high speed traffic in either a straight through or turnout direction.

Another object of the invention is a frog having movable wing rails which are firmly held in a closed or open position.

A further object is a frog having movable wing rails which are hinged to closure rails, the wing rails having a full rail base at the hinge.

Another object is a frog having movable wing rails in which lateral forces are not taken by the wing rails.

Another object is a frog having movable wing rails which are securely held in a vertical direction.

Another object of the invention is a frog having movable wing rails which can accommodate either a bolted or welded connection of the wing rails to the closure rails.

Still another object of the invention is a frog having movable wing rails wherein the point of the frog can be made of a manganese casting or from standard rail stock.

Another object of the invention is a frog having movable wing rails connected to a throw rod by swivel clips, with the swivel clips assisting in preventing rolling action of the wing rails.

A further object is an adaptor which permits attachment of the frog or other track work to concrete ties.

Other objects will appear from time to time in the following specification, drawings and claims.

BRIEF DESCRIPTION OF THE DRAWINGS

FIG. 1 is the toe end of the frog, FIG. 2 is the center section and FIG. 3 is the heel end of the frog. Match lines A are provided to indicate the joint between FIGS. 1 and 2 and match lines B indicate the joint between FIGS. 2 and 3.

FIG. 31 is an enlarged, detail section through an adaptor plate, showing an adaptor plate slot and one form of attachment element.

FIG. 32 is an end section of the adaptor plate slot of FIG. 31.

FIG. 33 is a plan view of an adaptor plate slot and attachment element.

FIG. 34 is a plan view of an alternate version of an adaptor plate slot and attachment element.

FIG. 35 is an enlarged, detail section of an adaptor plate, showing a further alternate form of the adaptor plate slot and attachment element.

FIG. 36 is an end section of the adaptor plate slot of FIG. 35.

FIG. 37 is a plan view of the adaptor plate slot of FIG. 35.

FIG. 38 is a plan view of an alternate form of adaptor plate slot.

DETAILED DESCRIPTION OF THE INVENTION

A. Introduction

Figures 1, 4:
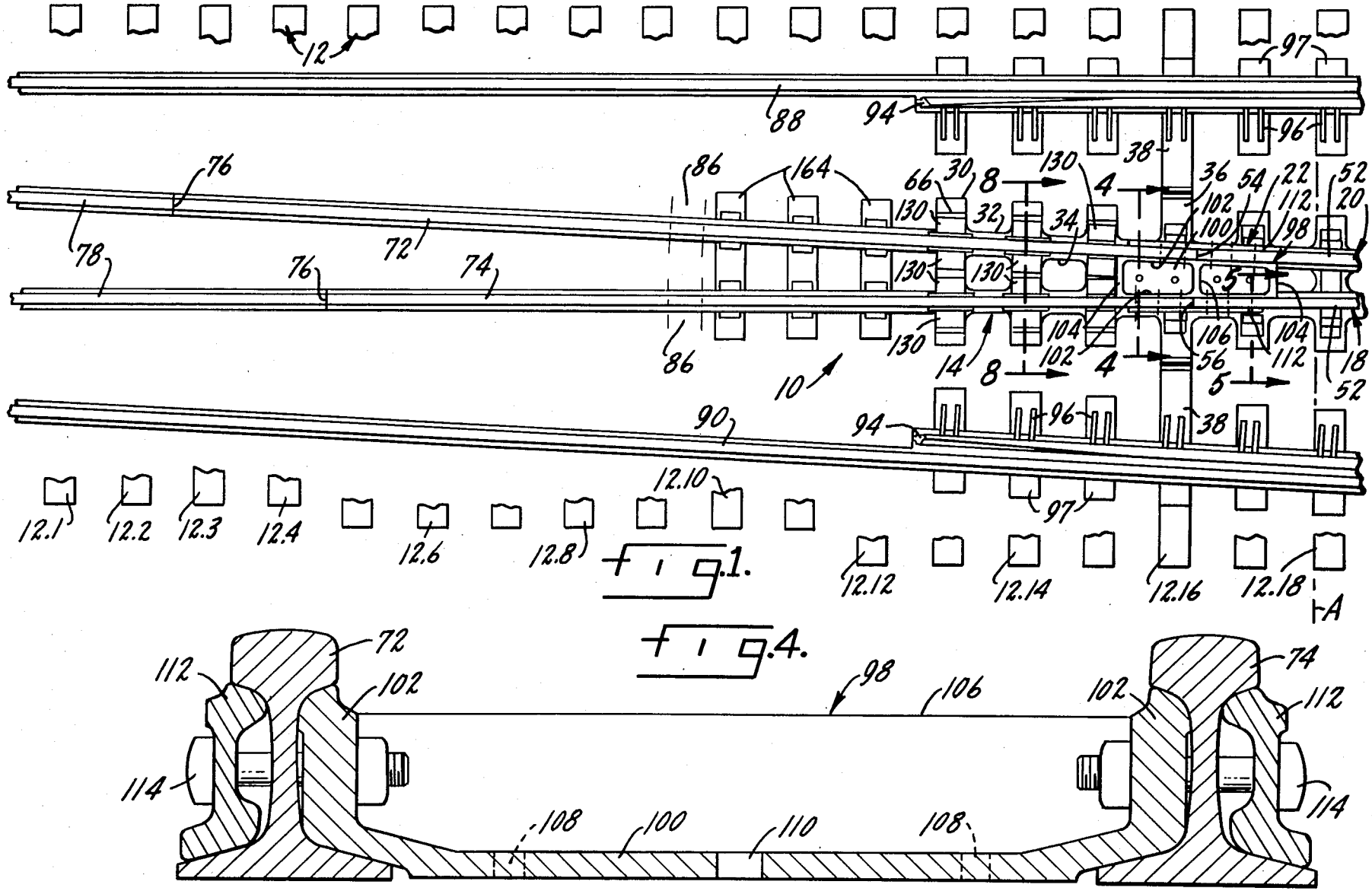
FIGS. 1-3 comprise a plan view of the frog of the present invention.
FIG. 4 is a section taken along line 4—4 of FIG. 1.
Figure 2:
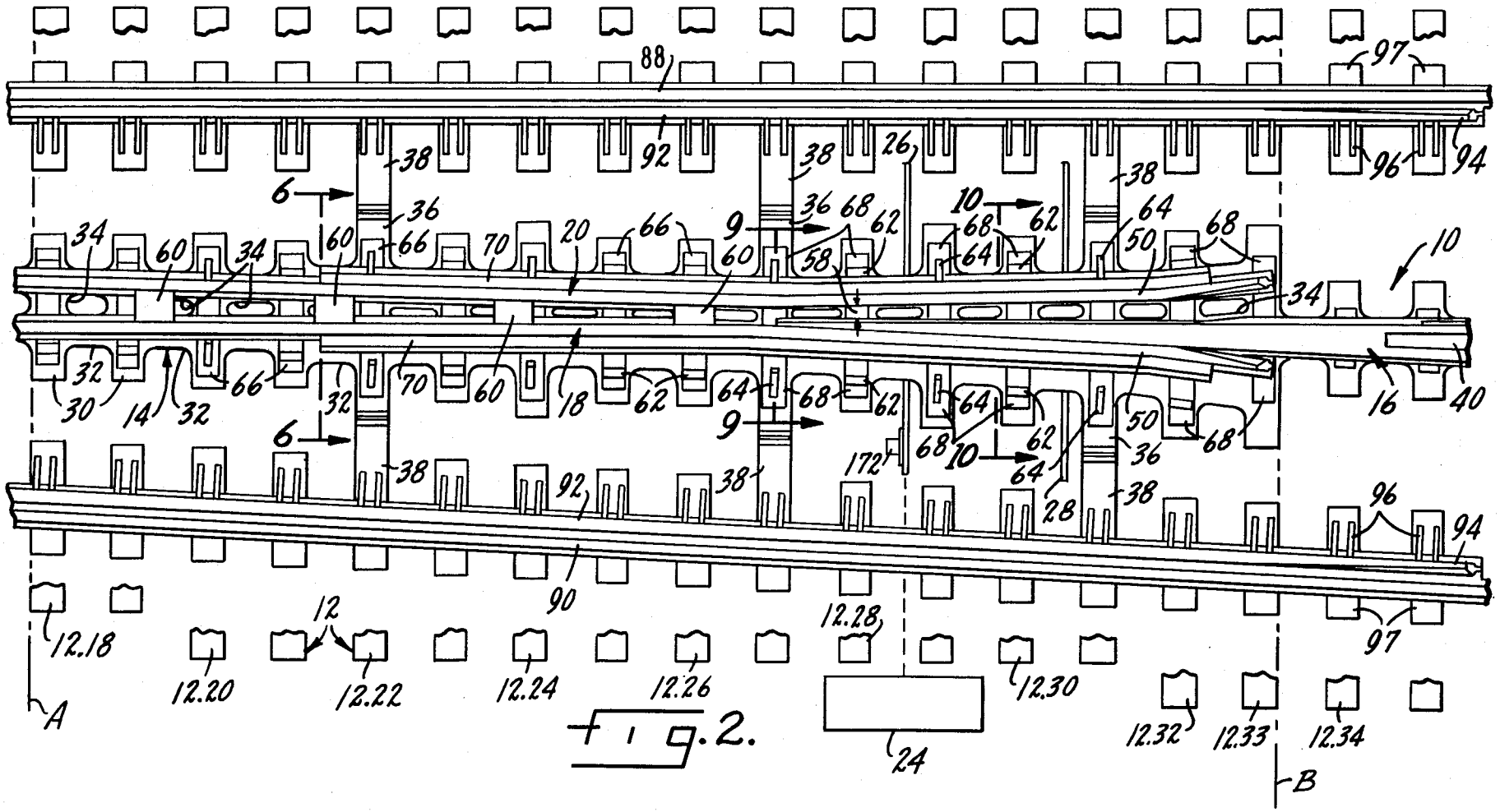
Figure 3:
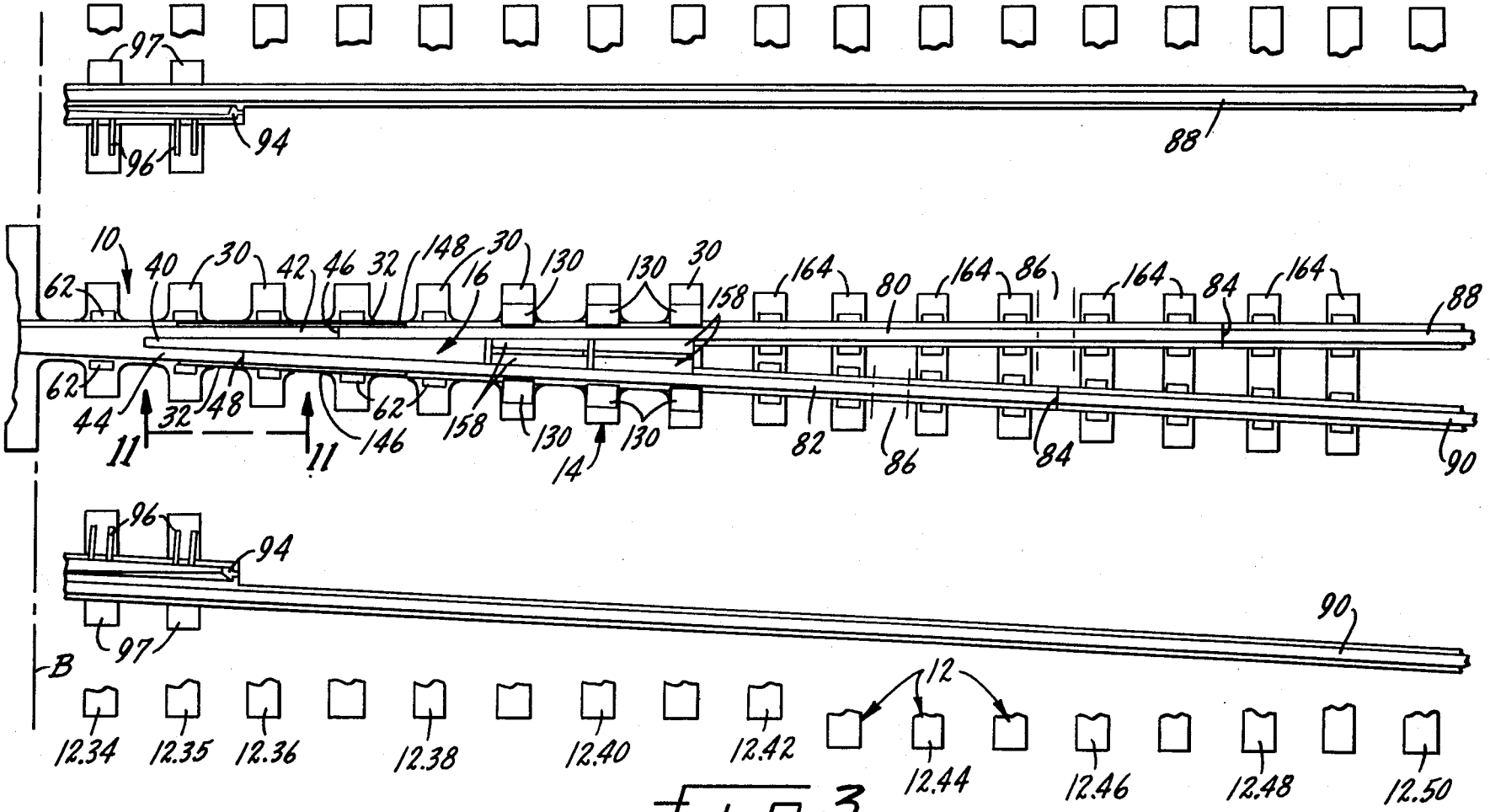

A railroad frog having movable wing rails is shown generally in FIGS. 1–3 at 10. The frog 10 is supported by ties 12. The ties are shown as end portions only. The individual tie locations are given decimal reference numerals (12.1, 12.2 etc.) for convenient reference. The ties at locations 12.13 through 12.35 are set deeper in the ballast so that there is a one inch height difference between the top surfaces of those ties and the top surfaces of the remaining ties. This tie offset creates a depression into which the major portion of the frog 10 fits.

The frog itself includes a long baseplate 14, a point 16, and a pair of movable wing rails including a right wing rail 18 and a left wing rail 20. The wing rails are connected to closure rails at the toe of the frog by a hinge 22. The term hinge is used broadly herein to indicate either a pivotal type of connection between separate rails or a bending or flexing type of motion of continuous rails. A switch machine shown diagrammatically at 24 throws the wing rails by means of connection to a throw rod 26. The throw rod is pivotally connected to the wing rails by swivel clips which are described in detail below. A second hold down rod 28 is similarly connected to the wing rails but it is not necessarily connected to the switch machine.

B. Baseplate

The baseplate 14 of the frog is a continuous plate extending from tie 12.13 to tie 12.41. Given a normal tie spacing of about 20½ inches, it can be seen that the overall baseplate length will be approximately 48 feet. This length is, of course, for reference only and the actual baseplate length will depend on the number of the frog.

Naturally a plate of that size will be assembled from smaller plates as required. The plates will be butt welded except at tie location 12.35 to 12.36 where there is a lap weld, as will be explained later. The baseplate is preferably one inch thick. It is fastened to the ties in any appropriate manner.

The baseplate 14 comprises a series of plate sections 30 joined by narrower connecting sections 32. The plate sections 30 are of varying widths and they rest directly on top of the ties, while the connecting sections 32 span the cribs. In the vicinity of the wing rails 18 and 20 the connecting sections 32 have a series of openings 34 which permit water and debris to fall into the cribs rather than remaining on the baseplate where they might obstruct motion of the wing rails.

Four of the baseplate sections have specially controlled widths. These are the gauge plates 36. The gauge plates are sized to extend exactly to the track axis on both the straight through and turn out runs of the frog. They are coupled to special gauge plates 38. These plates 38 are carefully sized to extend from the track axis to the traffic rails and thereby fix the position of the frog and traffic rails in the proper relationship. The number of gauge plates is dependent on the frog number (angle).

C. The Frog Point

The point 16 in this embodiment is a manganese steel casting. It rests directly on the baseplate 14 and is fixed in position by risers and plate clips which will be described later. From tie location 12.27 to 12.35 the height of the point equals the wing rail height plus the riser thickness. In other words, the wing rails must rest on the risers in order for the running surfaces of the point and wing rails to be at matching heights.

The point has a sloping surface 40 which has a 1 in 80 slope toward the heel. The slope protects the point from damage due to false flanges on passing car wheels. The false flange problem is described in detail in U.S. Pat. No. 4,362,282. Located on either side of the slope 40 are the main line running surface 42 and the turn out running surface 44. These surfaces terminate at left and right hand heel rail joints 46 and 48, respectively, forming notches into which the heel rails fit. Further details of the point are described below.

D. The Wing Rails

The wing rails 18 and 20 each have a free end 50 adjacent the point 16 and a fixed end 52 at the hinge 22. The designation "fixed end" is a relative term which is not intended to mean that this portion of the wing rail is necessarily absolutely rigid. Rather, the term "fixed" refers to the fact that this end is connected to closure rails and is fixed relative to the free end of the wing rail which is not connected to any other rails. The fixed ends 52 in the embodiment shown terminate at left and right toe joints 54 and 56.

The wing rails are positioned in the drawings for the straight through or main line direction. In this position the free end 50 of left wing rail 20 is spaced from the point 16 to form a flangeway 58. This wing rail free end is said to be in an open position. The free end of right wing rail 18 is shown in a closed position, wherein it cooperates with the point 16 to provide a substantially continuous running rail through the frog. The wing rails are movable between the open and closed positions about the hinge 22. The wing rails are held together by spacers 60 so that the throw rod 26 causes them to move as a unit. When the wing rails are thrown from the position illustrated, the left wing rail 20 would move to its closed position wherein the free end 50 contacts the point 16 and the right wing 18 would move to its opened position wherein it would be spaced from the point to form a flangeway. The throw is typically about four inches at the 12-inch point. The open positions for both wing rails are defined by series of stops indicated generally at 62 and 64.

The wing rails 18 and 20 are supported on risers which rest on the baseplate. There are two types of risers which are shown generally at 66 and 68.

The wing rails in the illustrated embodiment carry optional easer rails 70 which are bolted to the field side of the wing rails. The easer rails extend from about tie location 12.21 to 12.32. The easer rails have a slope at their ends nearest the toe. This may be, for example a 1 in 80 slope which protects the point from wear caused by false flanges. The easer rails also serve to stiffen the wing rails, particularly at the free ends where the gauge side of the wing rail base is cut away (see FIGS. 9 and 10). Although the use of easer rails is desirable, it is not required and forms no part of the present invention.

E. Associated Rails

Left and right closure rails 72 and 74 adjoin the wing rails at the toe joints 54 and 56, respectively. The closure rails extend to field welded joints 76 with rails 78. The rails 78 extend back to the switch points (not shown). The closure rails are connected to the hinge 22 in a manner which will be described below.

Looking at FIG. 3, left and right heel rails 80 and 82 extend from the left and right heel joints 46 and 48 to field welded joints 84. It will be noted that the field welded joints 76 at the toe end and 84 at the heel end are staggered to increase the section strength as discussed in U.S. Pat. No. 4,362,282.

The closure rails 72, 74 and heels rails 80, 82 each have a transition section indicated schematically at 86. Ordinary traffic rails are normally canted inwardly toward the track axis. In the frog the point and the wing rails are mounted in flat, non-canted relation to the baseplate. The transition sections 86 provide a smooth, gradual shift between the canted and non-canted portions of the track work. Thus, as traffic passes through the frog there will be a transition from canted to flat and back to canted rail. The transition sections occur between the ties, over about a nine inch length. The transition is actually a twist in the rail from a 1 in 40 cant to a flat rail.

The remaining rails include the main line traffic rails 88 and the turn out traffic rails 90. Each of the outside traffic rails has a guard rail 92 which extends from the heel of the frog to a point just past the wing rails. In the embodiment shown the guard rails 92 extend from tie location 12.13 to 12.35. The guard rails have flared ends 94 which present an angle of attack to the wheels of 2° or less. This small angle of attack reduces the lateral component considerably. The guard rails are held in place by braces 96 (which may be of the type shown in U.S. Pat. No. 3,964,679) and tie plates 97. The purpose of the guard rails is to remove lateral forces from the point and wing rails. While a guard rail is desirable it is not required.

F. The Hinge

One of the important aspects of the present invention is the hinge 22. The hinge is designed to have a full rail base at the pivot point or point of flexure. This design has the advantage of substantially strengthening the wing rails at the hinge and it eliminates stress risers. Details of the hinge will be described in conjunction with FIGS. 1, 4 and 5.

Figure 5:
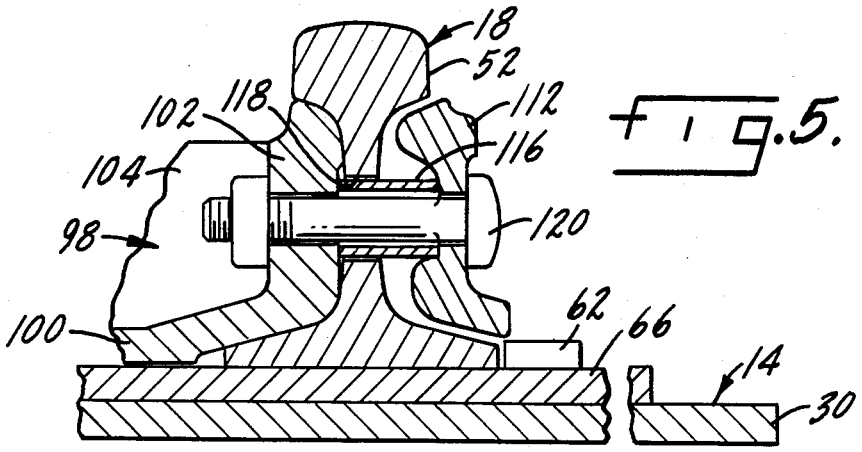
FIG. 5 is a detail section taken along line 5—5 of FIG. 1.

The hinge includes an anchor block shown generally at 98. The anchor block is a dish-shaped casting having a floor 100, two upstanding side walls 102, two end walls 104 and a center wall 106. The floor 100 has openings 108 for lag screws or bolts (not shown) which fasten the anchor block 98 to the baseplate 14. The floor also has drain holes 110 which permit water to run out of the anchor block. The side walls 102 project out and up into the web of an adjacent rail such that the side walls engage the rail base, web and the underside of the rail head. This construction is shown in FIGS. 4 and 5. It assists in stabilizing the fixed ends of the wings rails and the ends of the closure rails.

The hinge further includes joint bars 112 which are located on the field side of the closure rails and wing rails. On the closure rail side of the toe joints 54 and 56, the joint bars 112 rigidly fix the closure rails 72 and 74 to the anchor block side walls 102 by means of bolts 114 (FIG. 4). Three such bolts are shown diagrammatically in FIG. 1, although a different number could be used. In any event, the closure rails are rigidly connected to the anchor block. The hinge further includes a flexible connection at the wing rail fixed ends. The joint bar 112 extends across the toe joints 54 and 56 where it is adjacent to but spaced from the wing rail fixed ends 52. The joint bar is spaced from a wing rail by a thimble 116. The thimble extends through an opening 118 in the web of the wing rail's fixed end. Sufficient clearance is provided to allow the wing rail to move on the thimble. The joint bar 112, thimble 116 and anchor block 98 are rigidly held by a bolt 120 but the wing rail is provided with flexibility due to the spacing, as shown in FIG. 5. The flexibility is in a lateral direction only as no significant longitudinal play is allowed by the clearance of hole 118 about thimble 116. Again, FIG. 1 schematically shows three bolted connections 120 on each side of the anchor block. The number could be different.

In a preferred embodiment the joint bar 112 has a slight bend in it just to the right (as seen in FIG. 1) of the toe joints 54 and 56. The bend in the joint bar has a slight radius which establishes the pivot point for the fixed ends of the wing rails.

It will be noted that the construction of the hinge just described allows a full rail base at the hinge (see FIG. 5). It is not necessary to weaken the rail by removing part of the wing rail at the hinge.

G. Mechanical Restraining Elements

In order to accommodate the high speed traffic which this frog will carry, it is necessary that the frog be mechanically stable. While the wing rails are movable to provide bi-directional flangeways and continuous running rails, the wing rails must be fixed in their thrown position. It is imperative that alignment be maintained throughout the frog. The present invention provides a variety of mechanical restraints and positioning elements which will now be described.

Figure 6:
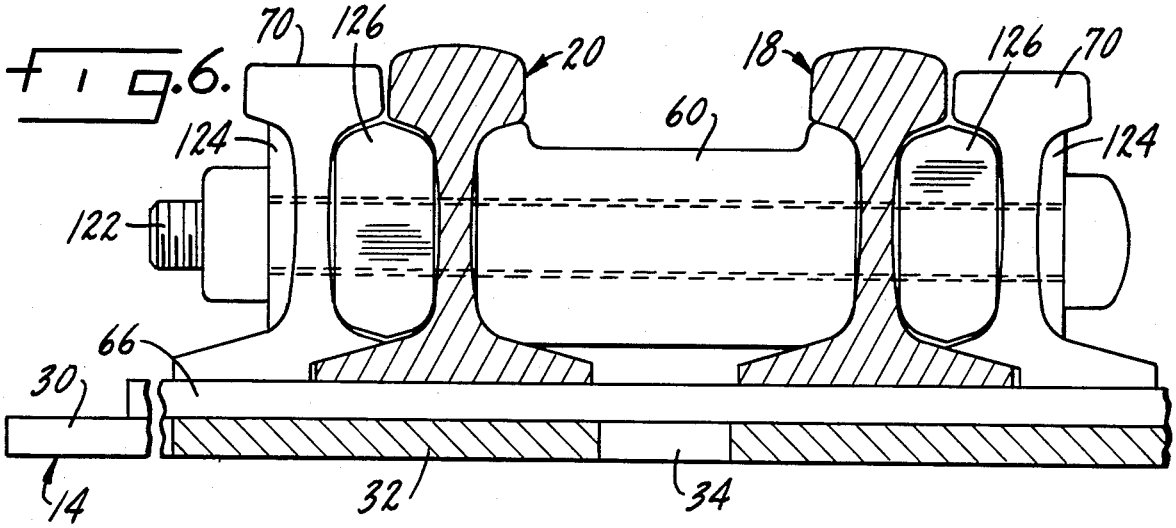
FIG. 6 is a section taken along 6—6 of FIG. 2.
Figure 7:
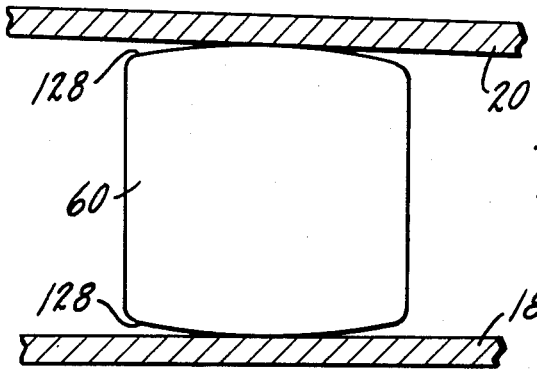
FIG. 7 is a section, on an enlarged scale, taken through the web portion of the wing rails, showing a spacer block.

A wing rail spacer 60 is shown in FIGS. 6 and 7. The spacer block 60 is bolted between wing rails 18 and 20 by a bolt 122. The head and nut of the bolt bear on D-bars 124 which engage the webs of the easer rails 70. Filler blocks 126 are placed between the easer rails and wing rails. When the wing rails are thrown there will be a slight tendency for them to slide relative to each other in a longitudinal direction. This tendency will create shear forces on the spacer blocks 60. As shown in FIG. 7 the spacer blocks have spherical end surfaces 128 which will readily accommodate these shear forces while maintaining the lateral spacing of the wing rails.

Figure 8:
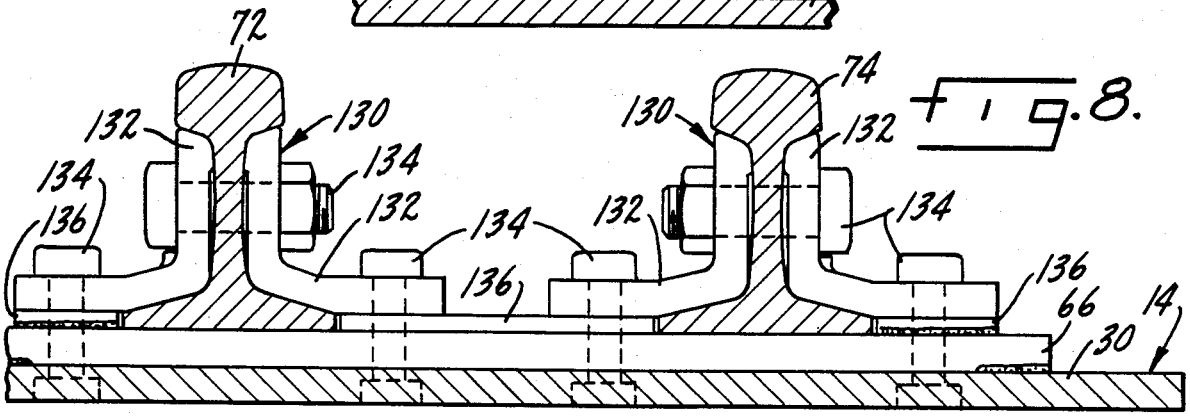
FIG. 8 is a section taken along line 8—8 of FIG. 1.

Longitudinal stability of the frog is provided by plate clips 130 which are attached to closure rails 72, 74 and the heel rails 80, 82. Specifically, the plate clips are provided at tie locations 12.13–12.15 and 12.39–12.41. Details of the plate clips are shown in FIG. 8. Each plate clip 130 includes a pair of angle members 132 engaging the head, web and base of a rail. The angle members are bolted to the rail webs and baseplate by bolts 134 as shown. Shims 136 are provided to compensate for the thickness of the rail base. At the heel end of the frog, the plate clips are connected to the point 16.

Figure 9:
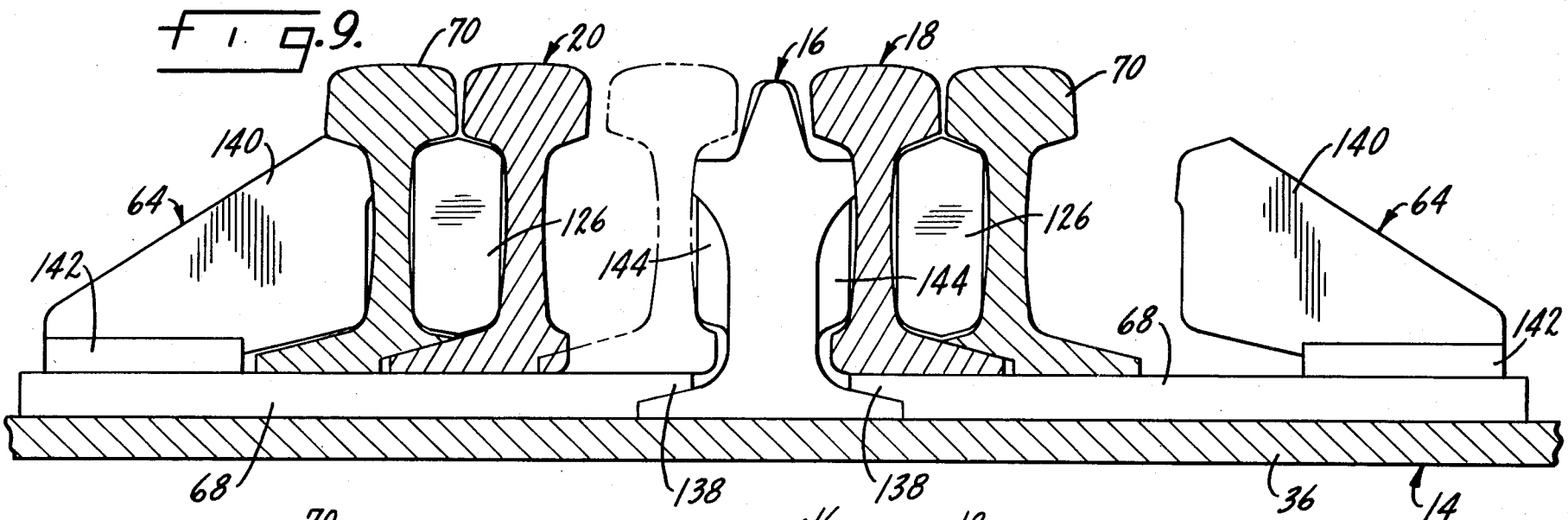
FIG. 9 is a section taken along 9—9 of FIG. 2, showing the point of the frog in elevation.
Figure 10:
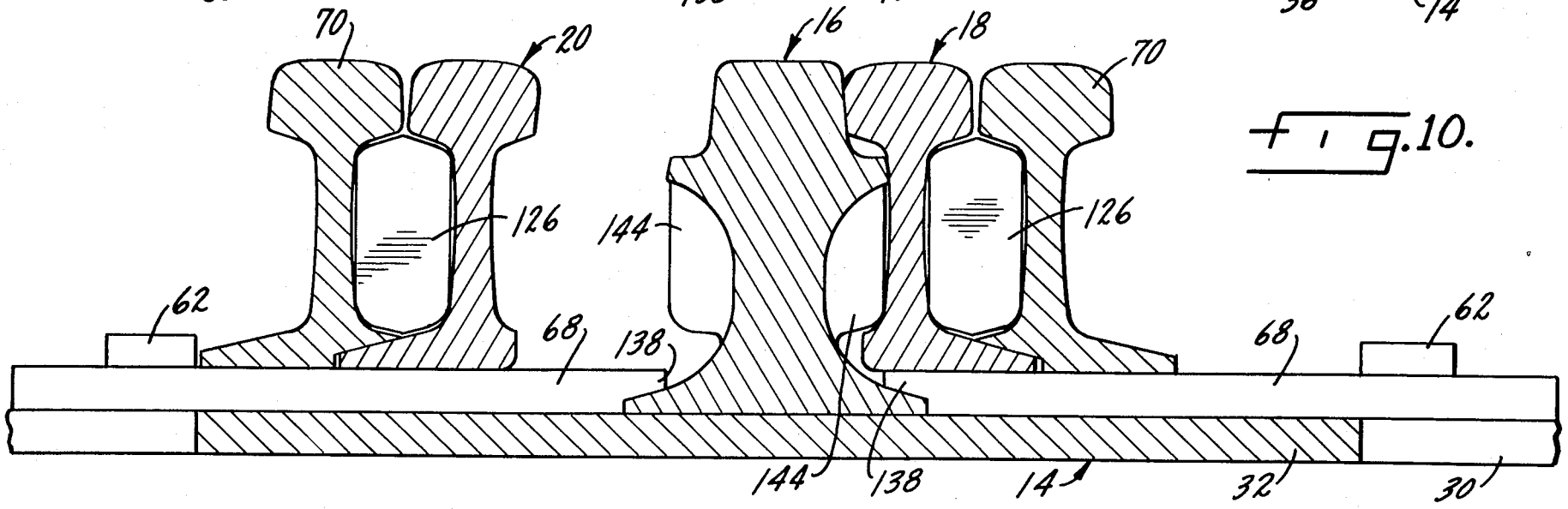
FIG. 10 is a section taken along line 10—10 of FIG. 2.

As mentioned above, a series of risers 66 and 68 is provided at tie locations 12.13 to 12.33. The risers are welded to the plate sections 30 of the baseplate 14. There are two types of risers. From ties 12.13 to 12.26 through risers 66 are used. These are simple, one-piece steel plates which extend under the wing rails. Through risers 66 are shown in FIGS. 6 and 8. The second type of risers are the clamp risers 68. They are provided in the area of the point 16, specifically from tie location 12.27 to 12.33. The clamp risers are shown in FIGS. 9 and 10. There are two clamp risers at each plate section 30 of the baseplate. They are located on either side of the point. Each clamp riser 68 has a lip 138 which engages the base of the point. The lip provides vertical and lateral restraint for the point. As was the case with the through risers, the wing rails and easer rails (if used) slide on top of the clamp risers 68. Also, FIGS. 9 and 10 clearly show the height relationship between the point 16 and the wing rails 20. Thus, it can be seen that the risers 68 have a dual function; they hold down the point 16 and they provide the additional height needed to match the running surfaces of the point and wing rails.

FIGS. 9 and 10 also illustrate the stops 62 and 64. The stops limit the wing rail motion and define the open position of the wing rails. Both types are welded to the risers. The brace type stop 64 includes an upright member 140 attached to a support 142. The upright member projects into the field side of the web of either a wing rail or easer rail (if used). The upright member 140 provides both vertical and lateral stability to the open wing rail. The second type of stop 62 is simply a small block which engages a rail base and resists lateral forces only. It will be noted that block type stops 62 are also located at ties 12.34 to 12.38 to hold the point in position.

The stops 62 and 64 for the wing rails are located on the elastic curve of the rails such that the force required to throw the rails is about 600 to 800 pounds. Locating the stops on the elastic curve also prevents the wing rails from being over stressed.

Vertical restraint of an open wing rail is provided by the throw rod 26, the hold down rod 28 and the brace 64. Vertical restraint of a closed wing rail is also provided by rods 26 and 28 and by a pad 144 formed on the point 16. The pad engages the wing rail base as shown in FIGS. 9 and 10.

Figure 12:
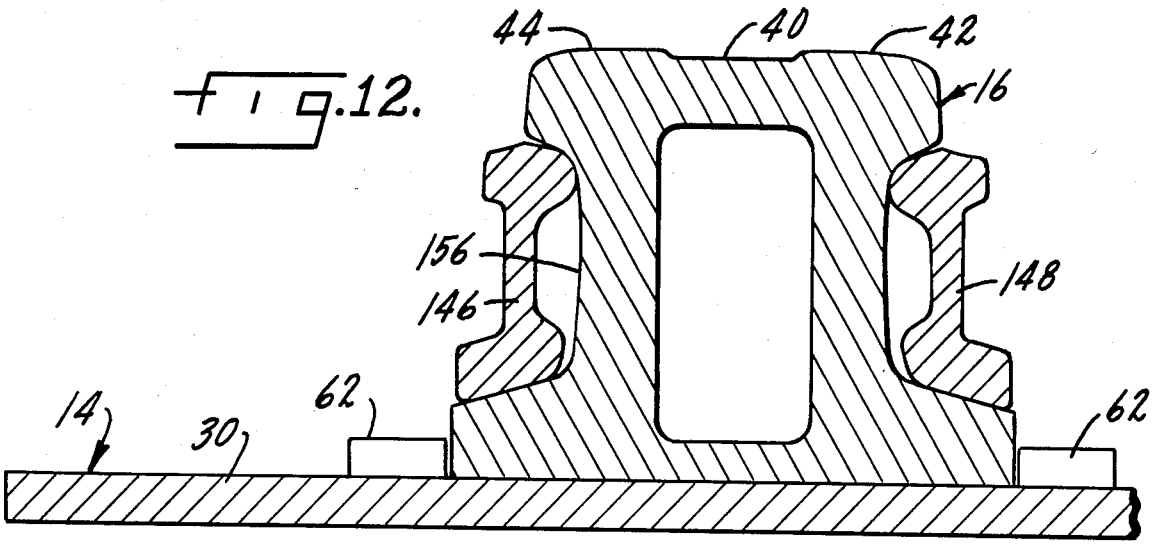
FIG. 12 is a section taken along line 12—12 of FIG. 11.
Figure 11:
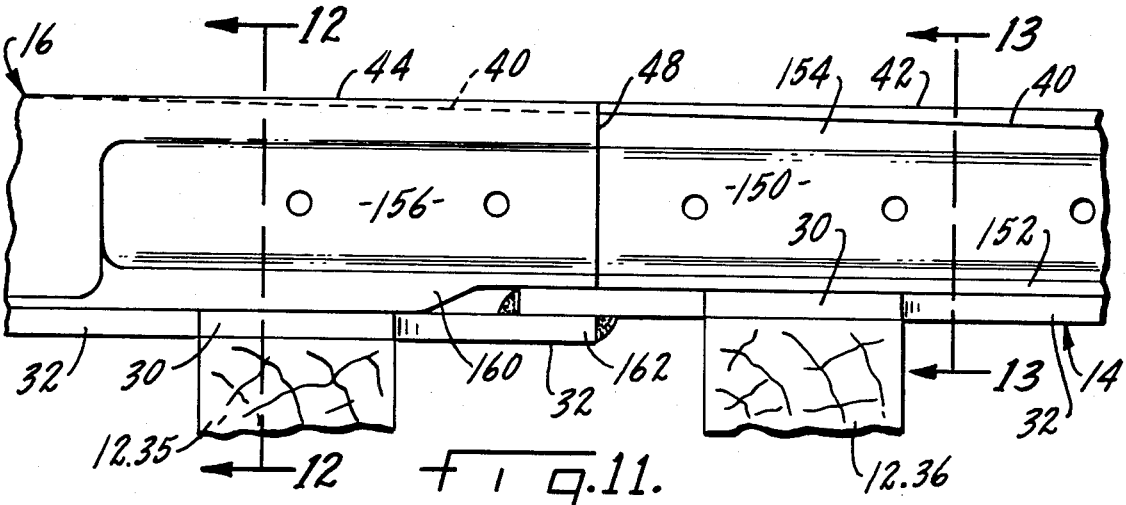
FIG. 11 is a side elevation view of the point-to-heel rail connection, looking in the direction of line 11—11 of FIG. 3.
Figure 13:
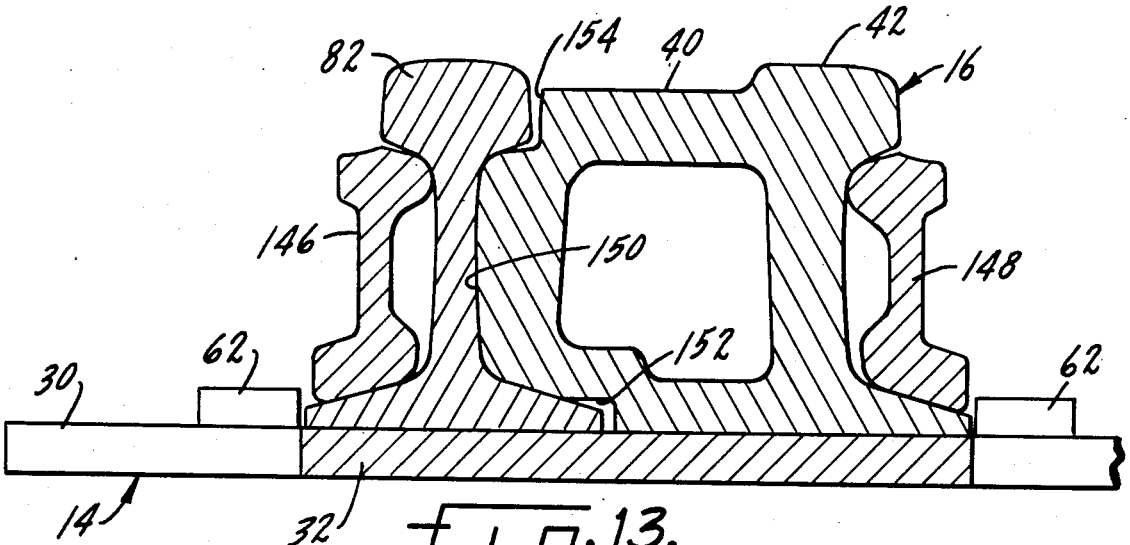
FIG. 13 is a section taken along line 13—13 of FIG. 11.
Figure 14:
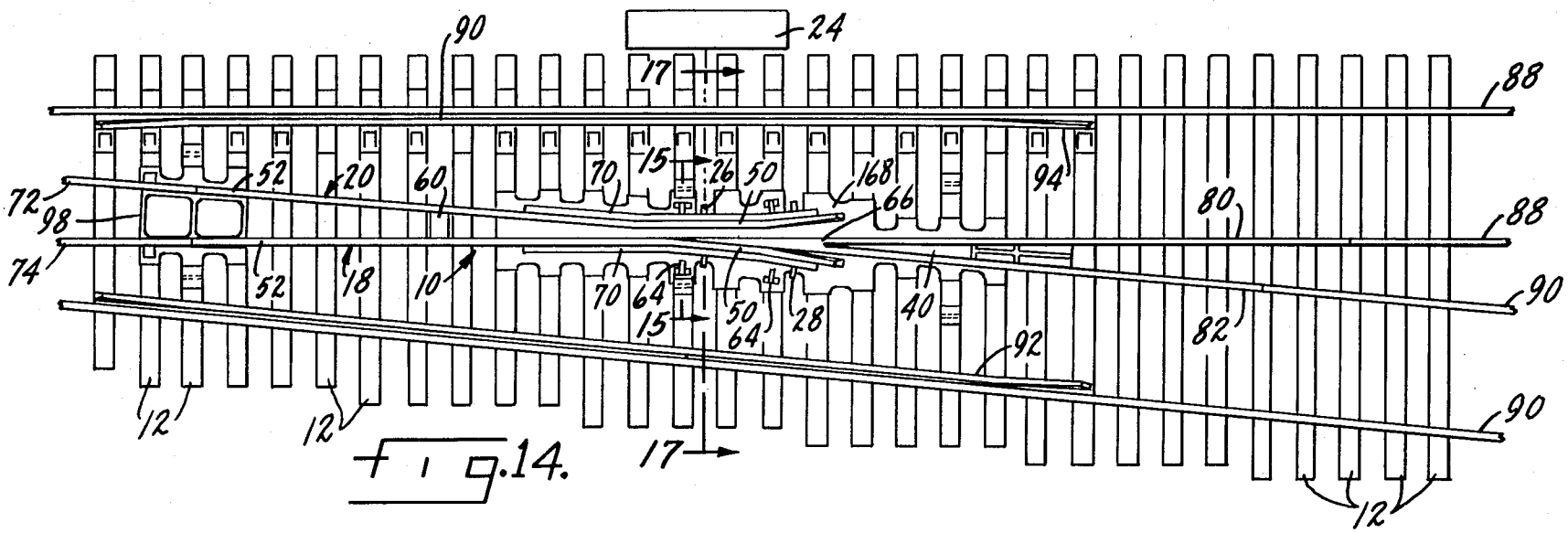
FIG. 14 is a plan view of an alternate embodiment of the frog of the present invention.

As discussed above, the left portion of the point is held down by the clamp risers 68. The right hand portion of the point is held by the heel rails 80, 82 which are in turn rigidly retained by plate clips 130. Details of the point-to-heel rail connection are shown in FIGS. 11–13. As can be see in FIGS. 12 and 13, the point 16 is a box section at this location. A pair of joint bars 146 and 148 are used to connect the point and the heel rail across the heel joints 46 and 48.

Looking at FIG. 11, the heel rail 82 and joint bar 146 have been removed to expose the point 16. To the right of the heel joint 48, the point has a protruding pad section 150 which engages the web of the heel rail 82. The pad is undercut at 152 to accept the heel rail base. The pad 150 also has a recess 154 for the heel rail head. To the left of the heel joint 48, the point 16 has a recess 156 into which the joint bar 146 fits. The joint bar is bolted to the point and extends to the gauge side of the heel rail 82 where it is bolted to the heel rail and the point. It will be noted that block stops 62 stabilize the lateral position of the point in this area. Heel spacers 158 maintain the heel spread as shown in FIG. 3.

FIG. 11 illustrates a change in the height of the point 16. The height changes between tie 12.35 and 12.36. The change actually occurs at a transition area labeled 160. To the left of the transition the point height is equal to the wing rail height plus the riser thickness. To the right of the transition the point height is the same as the wing rail or heel rail height. The baseplate 14 has a lap joint 162 just to the right of the transition area 160. Tie 12.35 is placed deeper in the ballast to accommodate this change in the baseplate without altering the elevation of the running surface.

As a final stabilizing device, special two-rail ties plates 164 are used at ties 12.10 to 12.12 and 12.42 to 12.49. These tie plates maintain the toe and heel spread. These special two-rail tie plates are used until sufficient spread exists between the rails to use two normal tie plates.

H. Alternate Embodiment: Welded Construction

As an alternate embodiment, the toe joints 54 and 56 are welded and the thimble 116 (FIG. 5) is eliminated so the wing rails are rigidly bolted to the anchor block 98, the same as the closure rails 72 and 74. With this welded construction the number of bolts could be reduced. Since there is no flexible joint in this construction it may be desirable to move the anchor block to the left (ie., away from the point) so that it might be sitting, for example, in the vicinity of tie locations 12.8 to 12.10. This would extend the length of the wing rails and make them more flexible. This would be desirable because the wing rails in the welded form will actually bend at the end wall of the anchor block. Thus, the anchor block establishes the point of flexure which then becomes the hinge. It will be noted that in the welded version a full rail base is still provided at the hinge. Also, the point of flexure is remote from the bolt holes.

As a further alternate the toe joints and connections of the wing rails to the anchor block could be made by epoxy bonding. Or one wing rail could have the bolted, pivotal connection while the other one is welded or epoxy bonded.

In the welded or epoxy bonded constructions it is problematic where the wing rails end and where the closure rails begin. For purposes of this disclosure the wing rails are considered to extend to the anchor block and beyond that the rails can be termed closure rails.

I. Alternate Embodiment: Point Integral With Baseplate

FIGS. 14–19 show a frog having a point which is cast as an integral part of the baseplate. This version is primarily the same as the embodiment of FIGS. 1–3. Parts which are common to the two embodiments are given common reference numerals and will not be described again.

Figure 15:
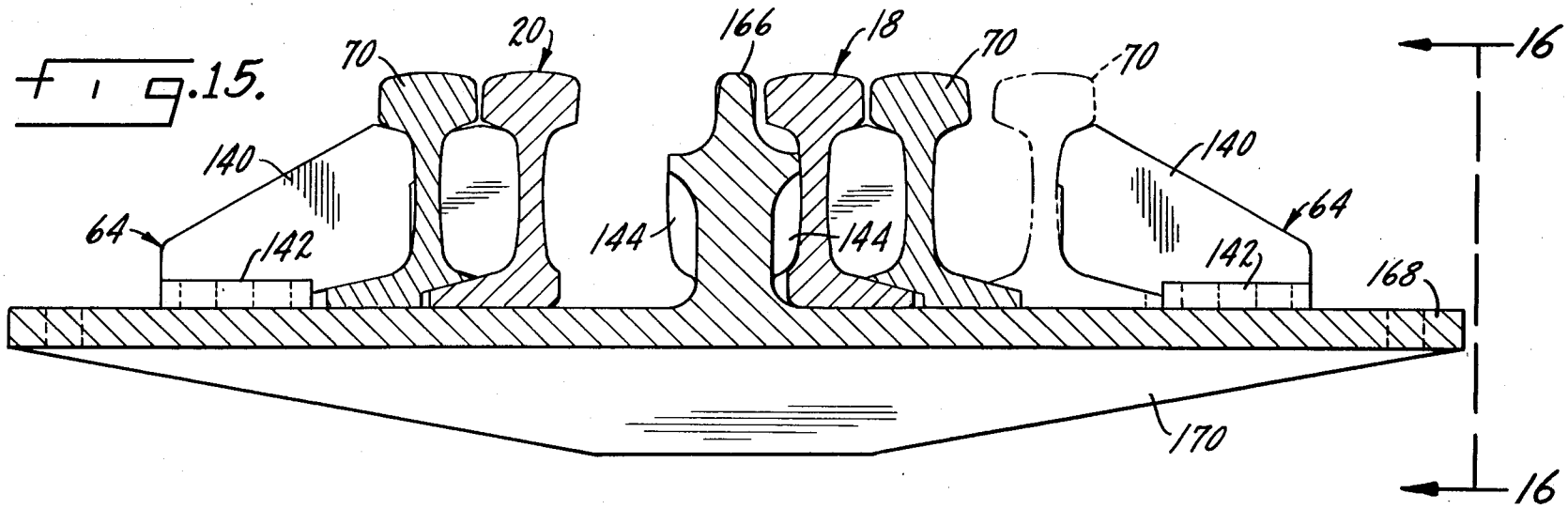
FIG. 15 is an elevation view looking at the point of frog, substantially in the direction of line 15—15 of FIG. 14, showing the rails in section.
Figure 16:
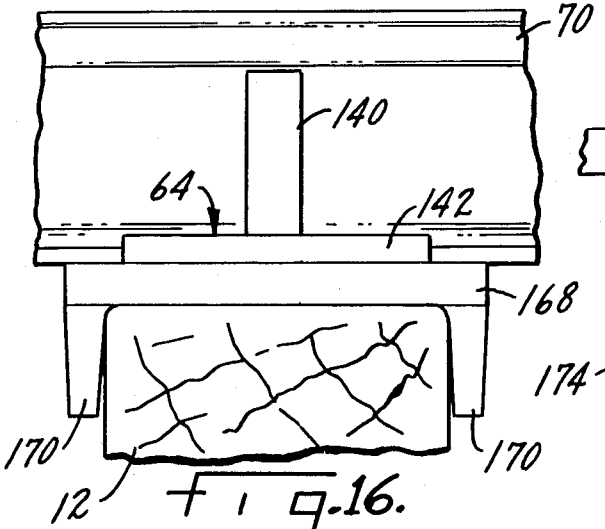
FIG. 16 is a side elevation view taken in the direction of line 16—16 of FIG. 15.

The point 166 is integrally cast with a baseplate 168. The baseplate 168 includes brace members 170 which depend from the underside of the baseplate. The brace members are spaced so as to accommodate the width of a tie between them. The brace members 170 then engage the tie to prevent longitudinal movement of the baseplate. The brace members are shown in FIGS. 15, 16 and 19.

J. Swivel Clips

Figure 17:
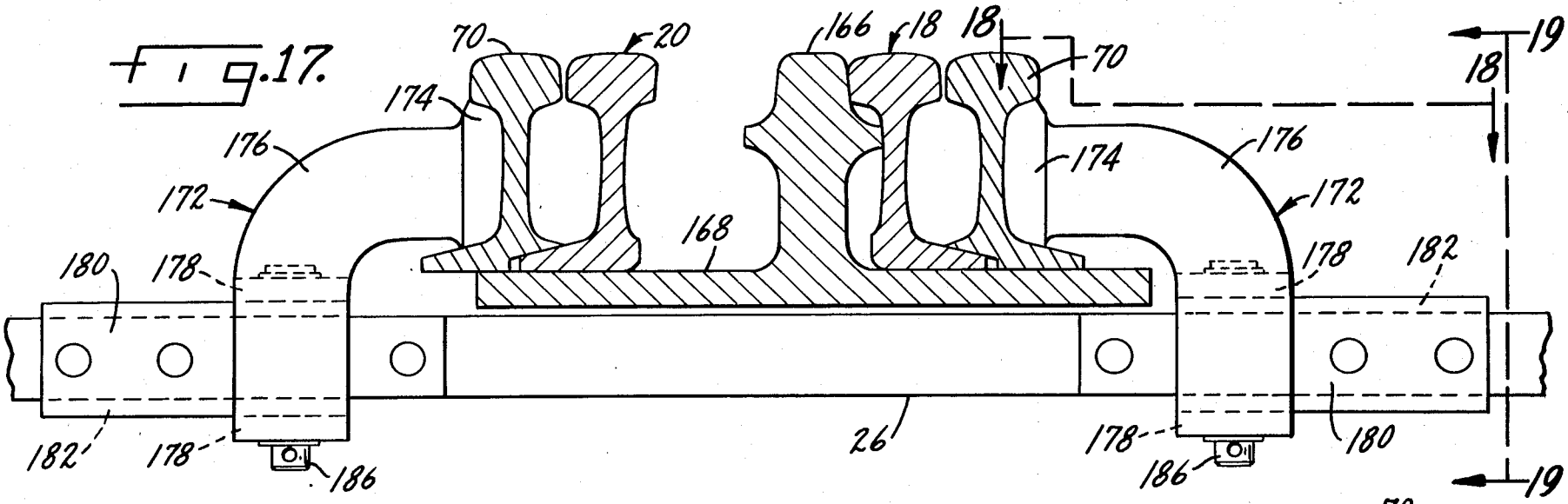
FIG. 17 is a section taken substantially at line 17—17 of FIG. 14.
Figure 19:
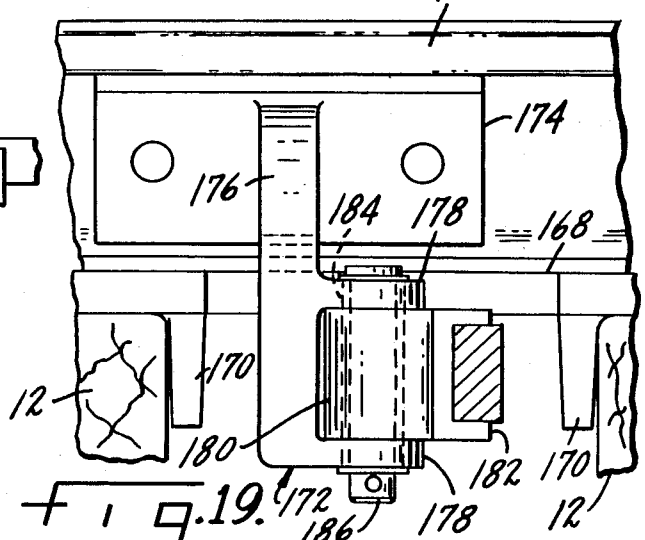
FIG. 19 is an end elevation view of a swivel clip, looking substantially in the direction of line 19—19 of FIG. 17.
Figure 18:
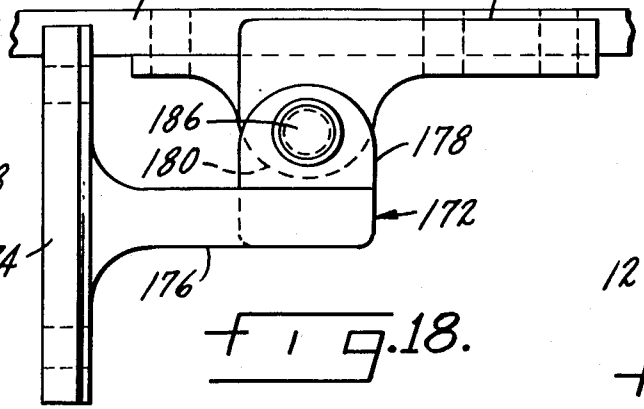
FIG. 18 is a plan view of a swivel clip, looking in the direction of line 18—18 of FIG. 17.

FIGS. 17–19 illustrate swivel clips 172 which provide the pivotal connection between the throw rod 26 and the wing rails 18 and 20. The throw rod 26 extends underneath the baseplate 168 and a swivel clip 172 is provided for connection to each of the two wing rails. Swivel clips are also provided for connection of the hold down rod 28 to each of the wing rails. Each swivel clip 172 includes a bar 174 connected to a wing rail. In the embodiment shown, this is done through the easer rails 70 and is preferably a bolted connection. An arm 176 integrally connected to the bar 174 extends from the bar downwardly to a point adjacent the throw rod 26. A clevis 178 is attached to the arm. In this case the clevis is integrally formed in the arm 176. A pin block 180 is attached to the throw rod 26 by a channel portion 182. The block itself fits into the clevis 178. The clevis 178 and pin block 180 have matching holes bored therethrough which receive a lubricated sleeve bearing 184 and a connecting pin 186. The sleeve bearing provides lubrication for the pivoting motion of the pin block and clevis. The pin block is preferably adjustably connected to the throw rod by means of bolts mounted in oval shaped bolt holes and by serrations in the rod and channel 182.

It will be noted that the pin block 180 has a rather elongated channel or sleeve-like portion 182 connecting it to the throw rod 26. Sleeve 182, as can be seen, complementally fits the throw rod and extends in an axial direction along the throw rod and beyond the clevis connection 178. Also, the wide separation of the clevis 178 allows a tall pin block to fit therein. The purpose here is to have the swivel clip 172 resist rolling action of the wing rail. Rolling action is the tendency of a rail to roll or twist about its base. The swivel clips 172 are designed to prevent rolling action. The swivel clips just described are identical to the ones intended for use in FIGS. 1–3. The pivotal connection between the throw rod and wing rails imparts flexibility which minimizes the stresses on the rod, the wing rails and the switch machine.

Figure 20:
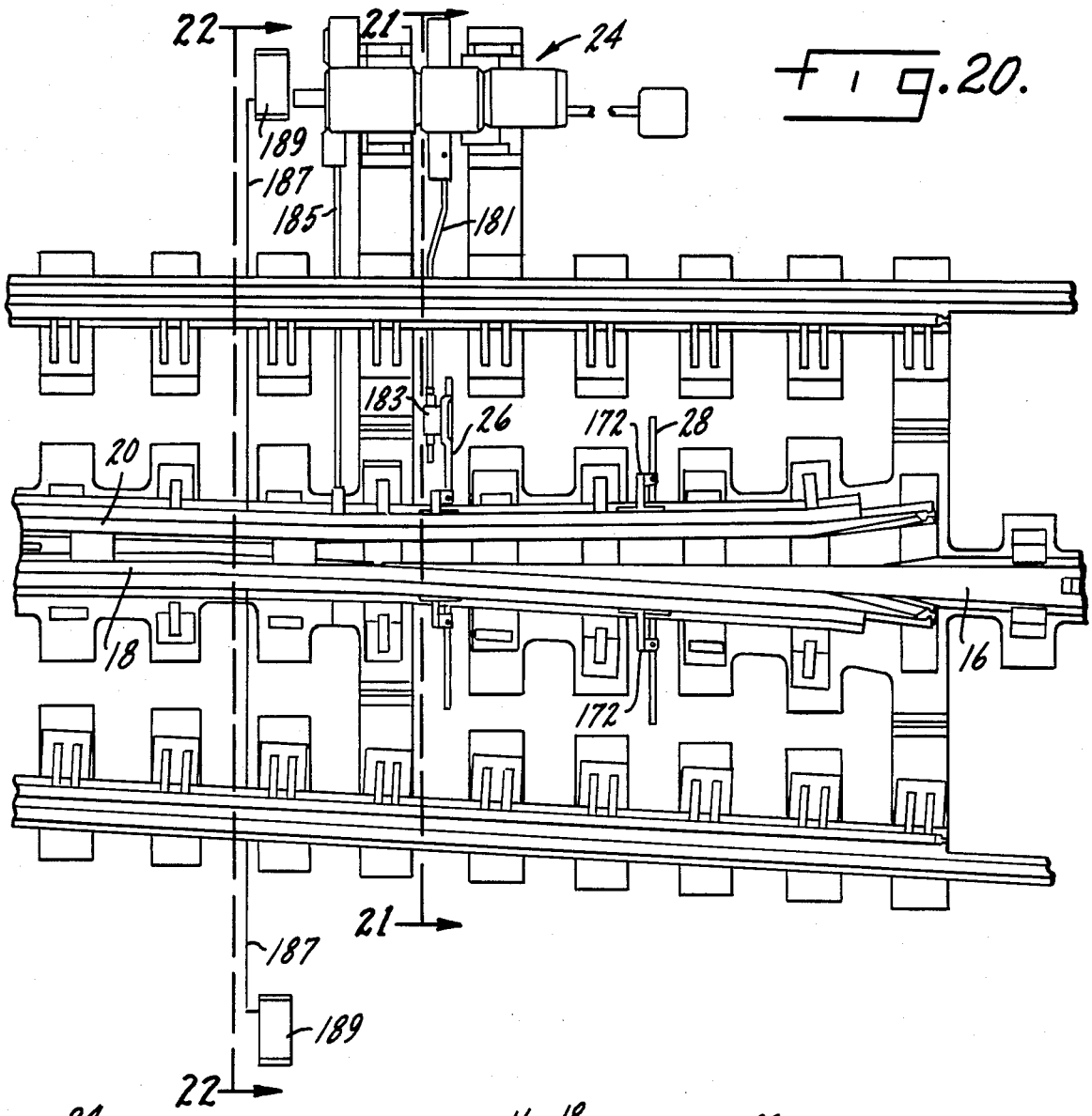
FIG. 20 is a plan view of a portion of the frog, in the vicinity of the point, showing details of the switch machine and its connection to the wing rails.
Figure 21:
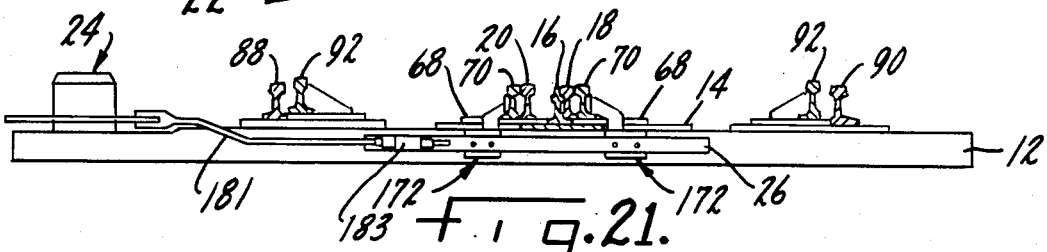
FIG. 21 is an elevation view, looking in the direction of line 21—21 of FIG. 20.
Figure 22:
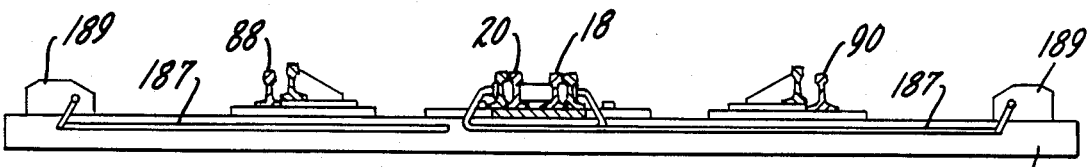
FIG. 22 is an elevation view, looking in the direction of line 22—22 of FIG. 20.
Figure 23:
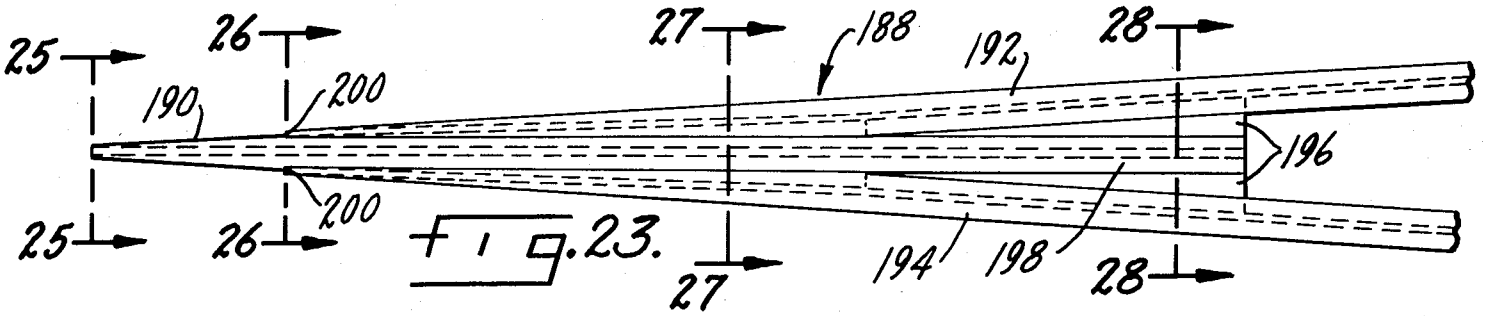
FIG. 23 is a plan view of an alternate embodiment of the frog point, showing a rail built point.

FIGS. 20–22 show further details of the wing rail operating mechanism. The switch machine 24 illustrated is a standard switch machine. This machine has an operating rod 181 which is connected to the throw rod 26 by a coupler 183. The switch machine further includes lock rods 185. The lock rods are connected to the wing rails to hold them in a thrown position. Moving wing detectors 187 are connected to switch boxes 189 and to the wing rails. They provide signals indicating the condition of the wing rails.

K. Alternate Embodiment: Rail Built Point

FIGS. 23–28 illustrate a point 188 which is fabricated from standard rail sections. Elements in these figures which are common to those previously described have common reference numerals. The rail built point 188 is disposed exactly on the center line of the frog. It includes a long point rail 190, a left short point rail 192 and a right short point rail 194. Filler blocks 196 are located between the long point rail and the short point rails to maintain spread and angle. The end of the long point rail is ramped at 198. A 1 in 80 slope has been found adequate to protect the point from damage due to false flanges. The long point 190 is notched on either side at 200 to accept the short point rails (see FIG. 23).

Figure 26:
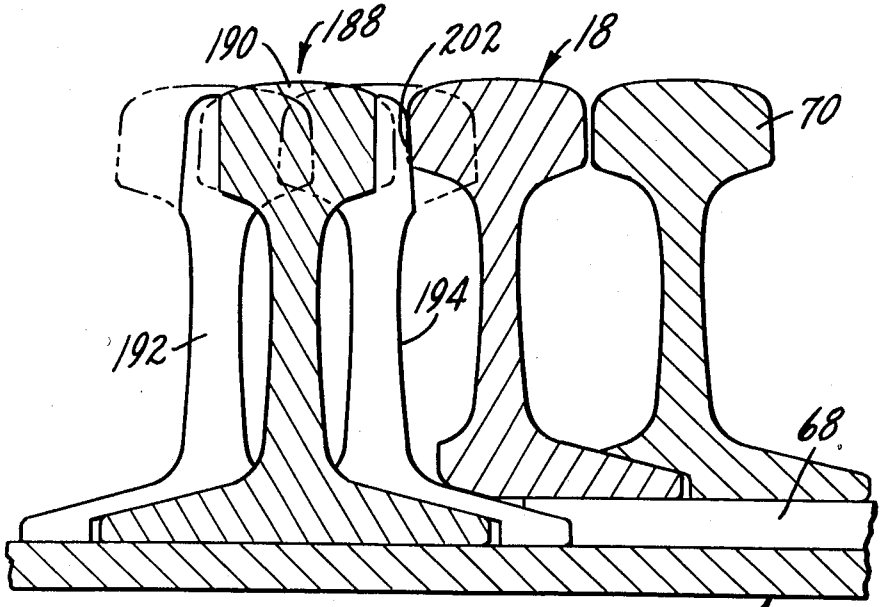
FIG. 26 is a section taken along line 26—26 of FIG. 23.
Figure 25:
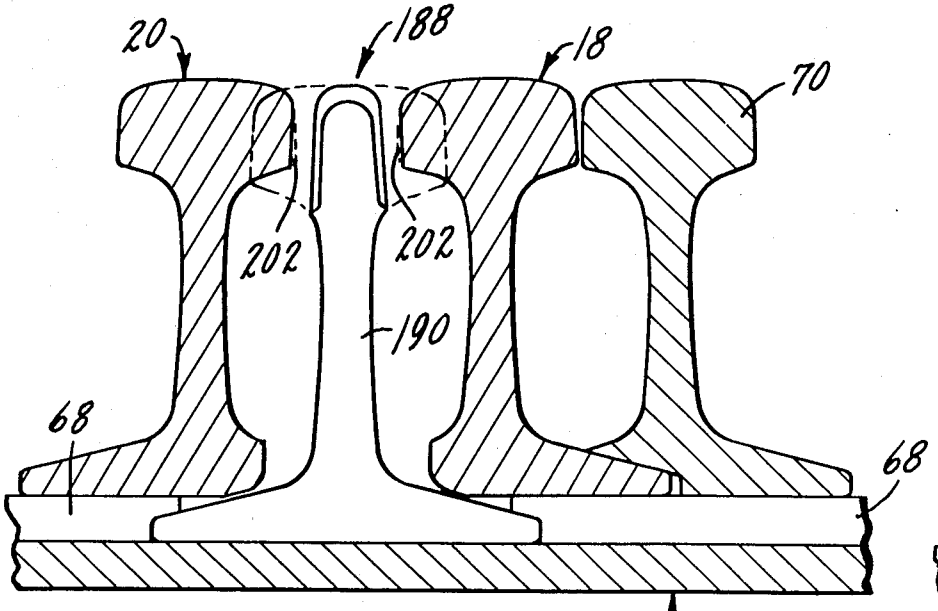
FIG. 25 is an elevation view taken in the direction of line 25—25 of FIG. 23.
Figures 24, 27, 28:
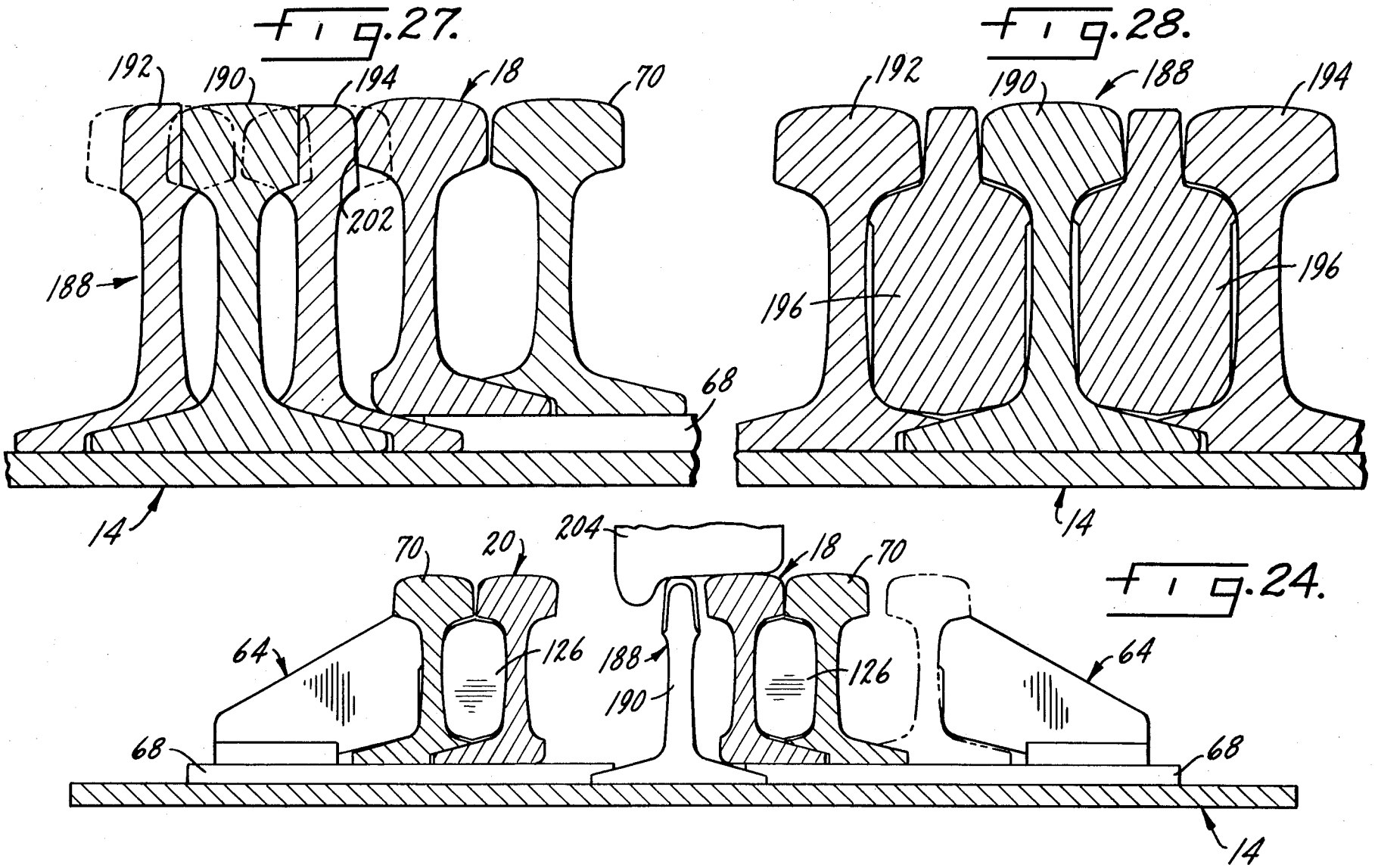
FIG. 24 is an elevation view with the rails in section taken at the point of frog, looking in the direction of the heel and showing a rail built point.
FIG. 27 is a section taken along line 27—27 of FIG. 23.
FIG. 28 is a section taken along line 28—28 of FIG. 23.

It will be noted in FIGS. 25–27 that the heads of the wing rails are undercut to the slope of the rail head, below the $\frac{5}{8}$ inch point. This is indicated at 202. This undercut allows the wing rail to seat firmly against the point 188. Finally in FIG. 24, a wheel 204 is shown to illustrate the relationship between the point 188 and wing rail 18 while a wheel is pasing over them.

L. Adaptor Plates For Use With Concrete Ties

Another aspect of the present invention is means for adapting the frog or other track work for application to concrete ties. The special problem presented by concrete ties is best demonstrated in conjunction with FIGS. 1–3. Concrete ties have connecting bolts or lugs embedded therein which protrude upwardly for connection to the track work. The location and spacing of these bolts is, of course, fixed and any track work attached to the concrete ties will have to conform to the spacing of the bolts. In normal tangent track this is no problem but in track work having turnouts it is a serious difficulty. This is illustrated in FIGS. 1–3, perhaps best by the turnout rails 90. As can be seen, those rails angle across the ties. With wooden ties spikes can be driven wherever needed along the length of the tie. Of course that is not possible with concrete ties and, absent some adjustability feature, each one of the ties 12.1 through 12.50 would have to be custom-made for its particular location so as to have the attachment bolts located in the proper manner to connect to the various rails and frog components at that point. The present invention provides an adjustment feature which greatly reduces the number of types of concrete ties required for a frog. In fact, the invention allows the various tie lengths to become the determining factor in the number of tie types rather than the different bolt spacings required.

Turning now to FIGS. 29–42, means are shown for fastening the frog or track work to concrete ties. Some of the components shown in these figures are common to those described above. They will be given common reference numerals.

Figure 29:
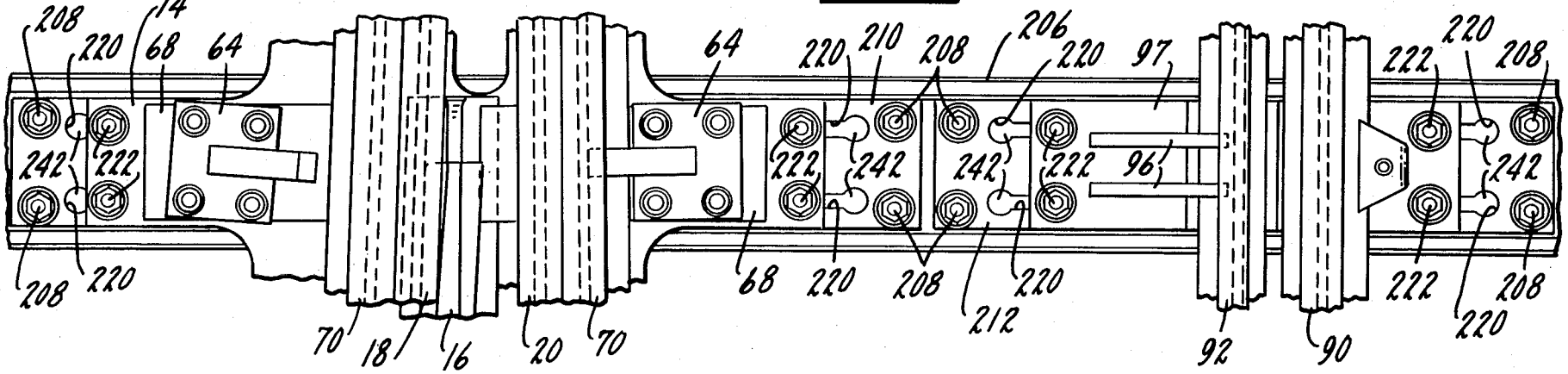
FIG. 29 is a plan view of the frog at a single tie, showing adaptor plates for use with concrete ties.
Figure 30:
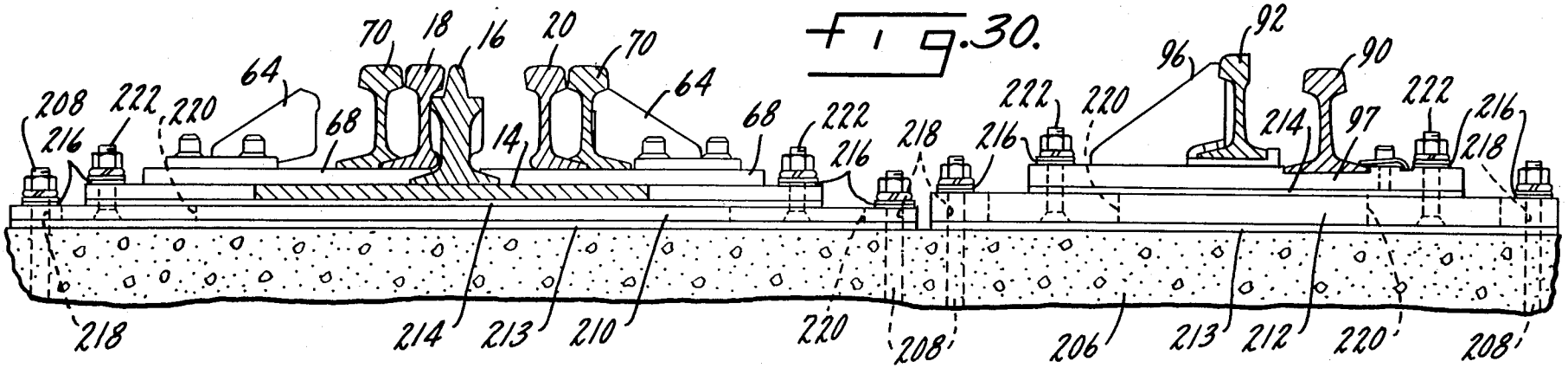
FIG. 30 is an elevation view at about the 1 inch point of the frog, showing the point, the wing rails and the turnout rails mounted on concrete ties by means of adaptor plates.
Figure 39:
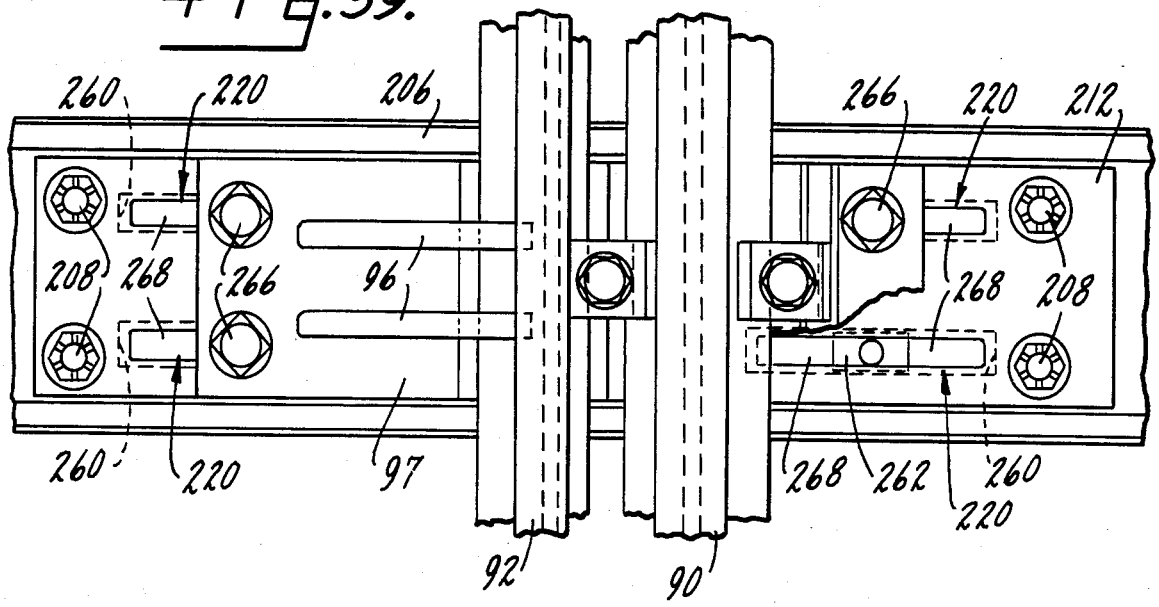
FIG. 39 is a plan view of yet another adaptor plate form, showing its attachment to a concrete tie.
Figure 40:
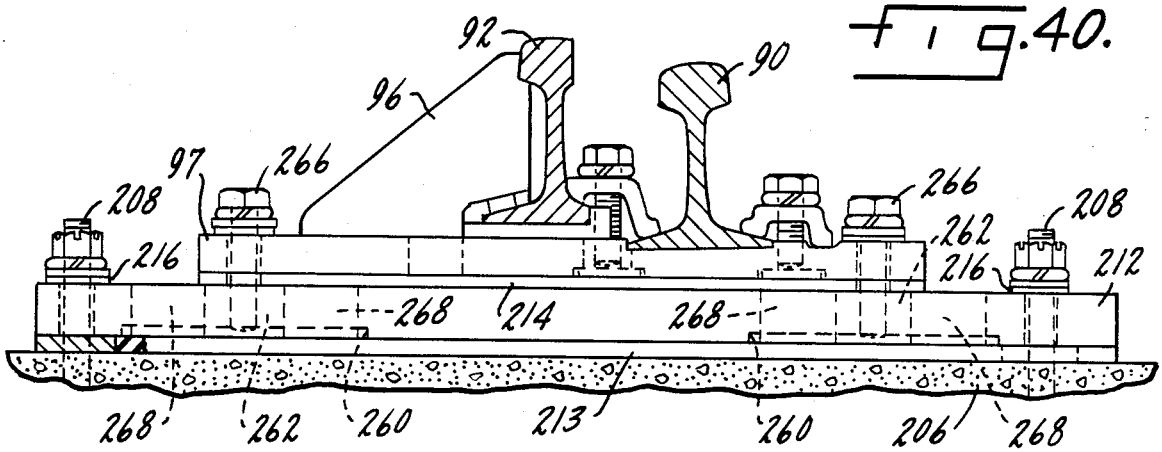
FIG. 40 is a side elevation view showing the adaptor plate of FIG. 39.
Figure 41:
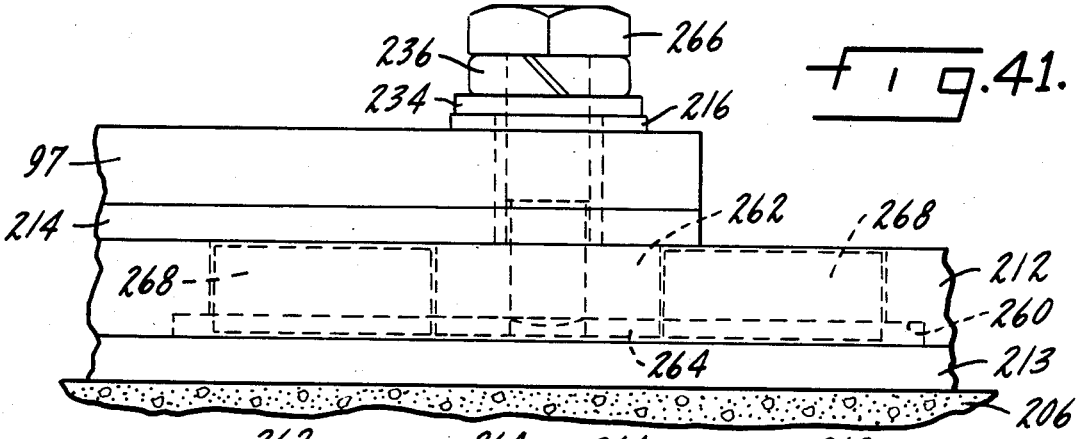
FIG. 41 is an enlarged, detail section showing the adaptor plate and attachment element of FIGS. 39–40.
Figure 42:
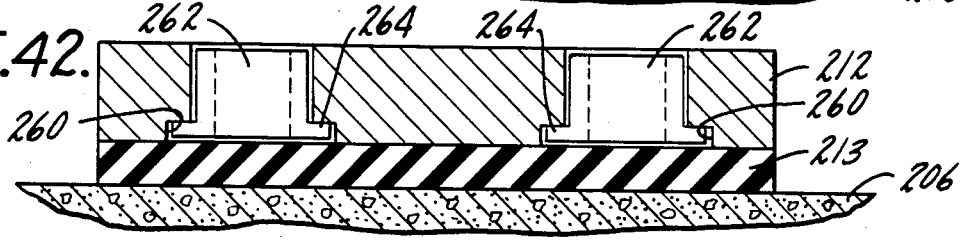
FIG. 42 is an end section showing the adaptor plate slot and attachment element of FIG. 41.

In FIGS. 29 and 30 the frog is attached to a concrete tie 206. The concrete tie has connecting bolts 208 embedded therein and protruding upwardly therefrom. For a given tie, the location and spacing of the bolts is fixed at the time of fabrication of the tie. The present invention utilizes adaptor plates, such as at 210 and 212, having an adjustment feature which makes the track work compatible with the bolt spacing of the concrete tie. The adaptor plates shown have different widths and thickness but in principle their operation is the same. An elastomer pad 213 is placed underneath each adaptor plate and a similar pad 214 is placed on top of the adaptor plate, underneath the track work. Similar elastomer washers 216 may be used under the metal washers of the various nuts. The purpose of the elastomer pad 213 is to dampen track waves and loading of wheels. The pads 214 and 216 dampen the rebound of the adaptor plates to prevent impact with the various nuts on the mounting bolts.

The adjustment feature of the adaptor plates will now be described generally; details are set forth below. Each adaptor plate has one or more openings 218 which conform to the spacing of the connecting bolts 208. The connecting bolts fit through the openings 218 to fasten the adaptor plate to the tie. The plates are held in place by nuts as shown. The adaptor plates have at least one slot 220 formed therein. An attachment element 222 is retained in the slot and is slidable therein in a direction transverse to the track axis (i.e. lengthwise of the tie). Thus, the attachment element 222 can be moved to whatever position required for connection of the attachment element to the track work.

FIGS. 31–33 show details of one form of the retainer slot 220. The slot is a double keyhole slot having rounded end portions 224 connected by a rectangular central portion 226. The central portion 226 has a rectangular undercut 228. The attachment element 222 in this embodiment is a one-inch plow bolt having a round countersunk head 230 and a square shank 232. A quarter-inch steel washer 234 and a one-inch spring washer 236 are held in place by a nut 238 which has a quarter-inch cotter 240. The head 230 of the bolt fits in the undercut 228 of the slot 220. This retains the bolt in the slot. The square shank 232 engages the sides of the central portion 226 of the slot to prevent rotation of the bolt during tightening of the nut.

An optional additional retention means may be provided in the form of plugs 242 which are inserted into the slot on either side of the bolt after the bolt has been properly positioned. The plugs have a keyhole shape to match that of the slot 220 and their length is variable, depending upon the position of the bolt. The plugs are field cut to the proper size. FIG. 34 illustrates a further alternate embodiment wherein the keyhole shaped end portion 224 is formed only on one end of the slot. The other end is square. If a plug is used in this form of the slot, it would be a simple rectangular plug as shown at 244.

FIGS. 35–38 show another alternate form of the slot 220 and attachment element 222. In this form the slot has T-shaped ends 246 connected by a central portion 248. An angled undercut 250 extends along the base of the central portion 248. The attachment element 222 has a square head 252 with sloping sides which match the angle of the undercut 250. The engagement of the square head with the surfaces of the undercut prevents the attachment element from turning during installation. A steel washer 234, a spring washer 236 and a cap nut 254 complete the structure. Two T-shaped plugs 256, similar to the plugs 242 described above, can be used to restrain the attachment element after it has been positioned. FIG. 38 shows the use of a single T-shaped plug 256 and a rectangular plug 258.

FIGS. 39–42 show a further form of adaptor plate. This version allows the track work to be bolted to the adaptor plate from above. A special nut is retained in the adaptor plate slot. The nut is slidable to the required position. Looking at the drawings, the slot 220 is a simple rectangular opening having a square undercut at 260. The attachment element comprises a nut 262 having a flange 264 which engages the undercut 260. Hold down bolts 266 extend through the track work and are threaded into the nut 262. This allows the track work to be bolted to the adaptor plate from above. Optional rectangular plugs 268, cut to the proper length, can be inserted in the slot to further restrain the nut 262.

I claim:

1. In a railroad frog of the type having movable wing rails hinged for lateral movement at a predetermined point and actuated by a throw rod which extends in a horizontal direction beneath the rails and transverse to the vertical axes of the wing rails, the improvement comprising swivel clips for pivotally connecting the throw rod to the wing rails and for resisting rolling action of the wing rails about their bases, the swivel clips comprising:

a bar connected to a wing rail;

an arm connected to the bar and extending downwardly to a point adjacent the throw rod;

a clevis attached to the arm;

a pin block attached to the throw rod; and a pin pivotally connecting the clevis and pin block, said pin block having an elongated sleeve portion complementally fitting a portion of the throw rod beyond the connection of the arm to the throw rod in an axial direction of the throw rod.

2. A railroad frog according to claim 1 in which the frog includes a fixed frog point between the wing rails, the frog having a toe and a heel, a base plate supported by ties and fixed thereto, said point being mounted on the base plate;

heel rails fixedly attached to the point, to the ties and to canted traffic rails at the heel of the frog, said canted traffic rails being inclined inwardly toward the longitudinal axis of the track system;

closures rails at the toe of the frog connected to the wing rails, to the ties and to canted traffic rails which are also inclined inwardly toward the longitudinal axis of the track system;

the wing rails and point being mounted in flat, noncanted relation to the base plate, and the heel rails and closure rails each having a transition section having a twist therein which provides a gradual transition between the canted traffic rails and the noncanted wing rails.

3. The swivel clip of claim 1 further comprising a lubricated sleeve bearing between the pin and the pin block.

4. A railroad frog according to claim 1 in which the frog includes a fixed point between the wing rails, a base plate supported by the ties and fixed thereto, said point being mounted on the base plate, and said wing rails being positioned above and slidable relative to the base plate;

and a plurality of risers attached to the base plate and slidably supporting the wing rails, said risers including a plurality of clamp risers adjacent to and on either lateral side of the point and engaging the base of the point to retain it in fixed position.

5. The frog of claim 4 wherein the limits of wing rail motion are defined in one direction by the point and in the other direction by a plurality of stops affixed to the risers.

6. The frog of claim 5 wherein the stops are located along the elastic curve of the wing rail.

7. The frog of claim 5 wherein the stops include blocks which engage a rail base only and braces which engage a rail web.

* * * * *